US007331509B2

(12) United States Patent
Bates et al.

(10) Patent No.: US 7,331,509 B2
(45) **Date of Patent: *Feb. 19, 2008**

(54) SEVERABLE CARTON WALL

(75) Inventors: Aaron Bates, Marietta, GA (US); James R. Oliff, Douglasville, GA (US)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/204,495

(22) Filed: Aug. 16, 2005

(65) Prior Publication Data

US 2005/0269389 A1 Dec. 8, 2005

Related U.S. Application Data

(62) Division of application No. 10/179,785, filed on Jun. 21, 2002, now Pat. No. 6,929,172.

(51) Int. Cl.
*B65D 17/00* (2006.01)

(52) U.S. Cl. ..... 229/242; 229/244; 229/122.1; 229/305

(58) Field of Classification Search ..... 229/244, 229/122.1, 305, 302, 303, 221, 241, 242, 229/243

See application file for complete search history.

(56) References Cited

U.S. PATENT DOCUMENTS 3,263,861 A 8/1966 Carr
3,335,940 A 8/1967 Dykes
3,356,279 A 12/1967 Root
4,396,143 A 8/1983 Killy
5,265,798 A 11/1993 De Maoi et al.
5,292,059 A 3/1994 Oliff
6,155,480 A 12/2000 Botsford et al.
6,176,419 B1 1/2001 Holley, Jr.
6,484,903 B2 11/2002 Spivey et al.

FOREIGN PATENT DOCUMENTS

WO WO 02/047990 A3 6/2002

*Primary Examiner*—Tri M. Mai

(57) ABSTRACT

A severable carton wall includes a substantially vertically disposed composite wall formed from a pair of overlapping panels joined along a seam, and a frangible line extending across the composite wall, traversing the seam, defining a removable upper portion of the composite wall. An extensively-weakened segment of the frangible line that substantially traverses the seam is shaped and disposed such that the extensively-weakened segment defines a notch in the removable upper portion within the seam of the removable upper portion. The extensively-weakened segment includes a pair of cut lines formed respectively in the end portions of the panels such that the cut lines define a pair of secured protrusions formed respectively from the panels and extending upwardly from the lower portion of the composite wall.

15 Claims, 4 Drawing Sheets

SEVERABLE CARTON WALL

This is a division of application Ser. No. 10/179,785, filed Jun. 21, 2002, now U.S. Pat. No. 6,929,172, which is hereby incorporated by reference.

TECHNICAL FIELD OF THE INVENTION

The invention relates to cartons, and more particularly to cartons having a wall severable along a frangible line of severance wherein the line of severance traverses a joinder of panels.

BACKGROUND OF THE INVENTION

Cartons made of flexible material, such as paperboard, are often used in a manner that requires that one of the carton walls be partially or fully severed to gain partial or full access to the interior of the carton. Sometimes access is for the purpose of removing or depositing articles such as beverage cans or bottles. Typically, the carton is severable along a frangible region or line such as a perforated line or tear strip. An example of a carton wherein at least a portion of the carton wall is severable is U.S. Pat. No. 5,518,111.

In order to be effective for the packaging of articles, a carton typically must be constructed in some type of arrangement wherein a partially or fully enclosed structure is formed. For example, a quadrilateral-shaped tubular structure such as the carton of U.S. Pat. No. 5,518,111. Cartons are typically erected from flat sheets known as blanks. To form such a closed carton structure, it is typically necessary to join certain regions of the blank in some fashion. The ends of carton panels are typically joined by adherence such as gluing. A seam is generally formed where the panel ends overlap.

Often, it may be desirable to sever a carton wall across a joinder of panels. It is generally more difficult to tear across a carton seam than an un-joined carton wall. The seam is essentially a reinforced region because it is multiple-ply and any adhesive used typically adds its own resistance to shearing. A carton wall may de-laminate, that is, come apart in layers, or otherwise have portions that give way in an undesirable manner due to the resistance to shearing presented by a seam. Thus, it can be appreciated that it would be useful to have a means for severing a carton wall across a seam.

SUMMARY OF THE INVENTION

According to one aspect of the invention, a severable carton wall is provided. The carton wall comprises a substantially vertically disposed composite wall formed from a pair of overlapping panels joined along a seam, and a frangible line extending across the composite wall, traversing the seam, defining a removable upper portion of the composite wall. The seam of the composite wall comprises an overlap of the respective end portions of the panels. A segment of the frangible line that substantially traverses the seam is an extensively-weakened segment that is shaped and disposed such that the extensively-weakened segment defines a notch in the removable upper portion within the seam of the removable upper portion. The extensively-weakened segment includes a pair of cut lines formed respectively in the end portions of the panels such that the cut lines define a pair of secured protrusions formed respectively from the panels and extending upwardly from the lower portion of the composite wall to facilitate separation of the composite wall along the extensively-weakened segment.

In a preferred embodiment of the invention, each cut line may have a highest point along the respective cut line. The highest point along one of the cut lines may be disposed at a lower elevation than the highest point along the other cut line. The one cut line may be formed in the panel that is disposed outermost with respect to the seam while the other cut line may be formed in the other panel that is disposed innermost with respect to the seam. The cut lines may extend alongside each other such that a clearance is provided between the cut lines In another preferred embodiment, each cut line may terminate at a nick member disposed proximate the end edge of the respective panel.

In a further preferred embodiment, the protrusions are joined directly to the lower portion of the composite wall without any hinged connection, such as fold lines, between the lower portion and the protrusions.

The present invention in another aspect provides a carton that comprises top, bottom and a pair of side walls interconnected to form a substantially tubular structure. The tubular structure has at least one end region terminating in a composite end wall. The composite end wall is formed from a pair of overlapping panels joined together along a seam that comprises an overlap of the respective end portions of the panels. The carton further comprises a separable trough formed from a portion of the one end region and hingably and severably connected to the composite end wall along a frangible line that traverses the seam. The frangible line comprises a pair of spaced, substantially straight segments extending respectively from the side walls toward each other and an extensively-weakened segment substantially traversing the seam and spanning a space between the straight segments. The extensively-weakened segment is configured such that the extensively-weakened segment defines a notch in the trough within the seam of the trough whereby when the trough is partially severed from the carton and pivoted about the straight segments, severance of the trough from the carton along the extensively-weakened segment is facilitated.

In a preferred embodiment of the second aspect of the invention, the straight segments may be interconnected by the extensively-weakened segment only.

In another preferred embodiment, the extensively-weakened segment may include a pair of cut lines formed respectively in the end portions of the panels such that the cut lines define a pair of secured protrusions formed respectively from the panels and extending upwardly from the composite end wall when the trough is partially severed from the carton and pivoted about the straight segments. The protrusions may be joined directly to the composite end wall without having any hinged connection between the composite end wall and the protrusions. Each cut line may have a highest point along the respective cut line. The highest point along one of the cut lines may be disposed at a lower elevation than the highest point along the other cut line. The one cut line may be formed in the panel that is disposed outermost with respect to the seam while the other cut line may be formed in the other panel that is disposed innermost with respect to the seam. Each cut line may terminate at a nick member disposed proximate the end edge of the respective panel.

In a further preferred embodiment, the trough may be formed in part from the top wall, in part from the composite end wall and in part from the side walls. The trough may be severably connected to the top and side walls.

In a further preferred embodiment, the frangible line may be disposed across the composite end wall and may extend into the side walls so that the trough is severably connected to the side walls. The frangible line may extend into the top wall such that the frangible line extends across the top wall.

Other advantages and objects of the present invention will be apparent from the following description, the accompanying drawings, and the appended claims.

BRIEF DESCRIPTION OF THE SEVERAL VIEWS OF THE DRAWINGS

Exemplary embodiments of the invention will now be described by way of example only, with reference to accompanying drawings in which.

DETAILED DESCRIPTION OF THE PREFERRED EMBODIMENT

Figure 1:
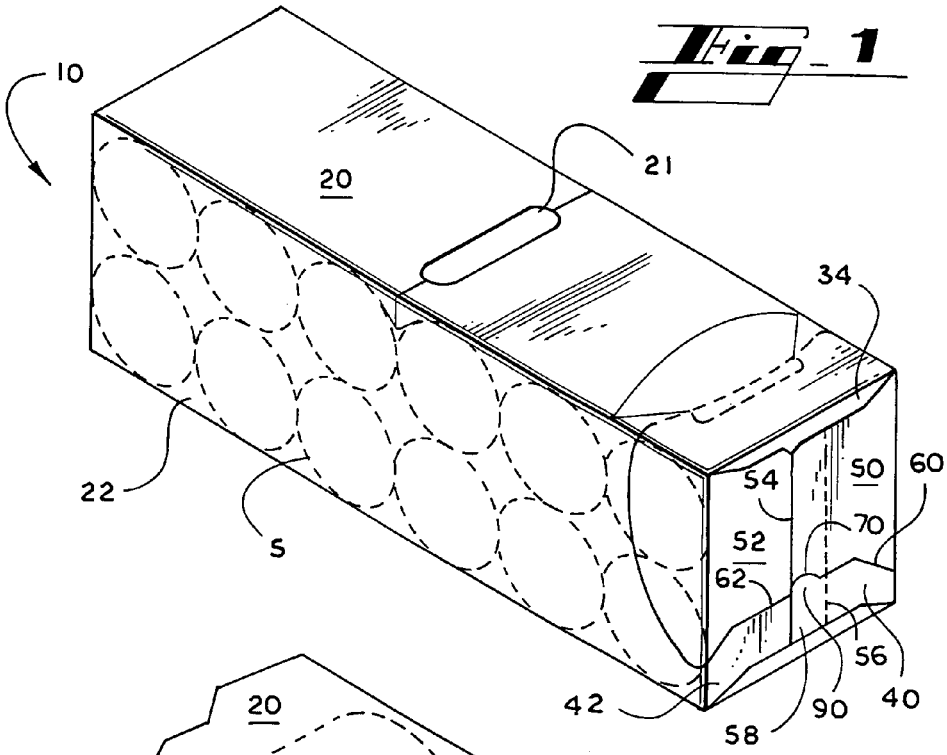
FIG. 1 is a perspective illustration of a carton having a severable wall in accordance with a preferred embodiment of the invention.

Throughout the drawings, the same reference numerals are used to denote the same or like features of the invention.

Referring first to FIG. 1, therein is illustrated a carton 10 having a severable carton wall in accordance with the teachings of the present invention. For purposes of describing the invention, an elongated tubular carton 10 is illustrated. However, the teachings of the invention are not limited to any particular carton shape or configuration.

Figure 5:
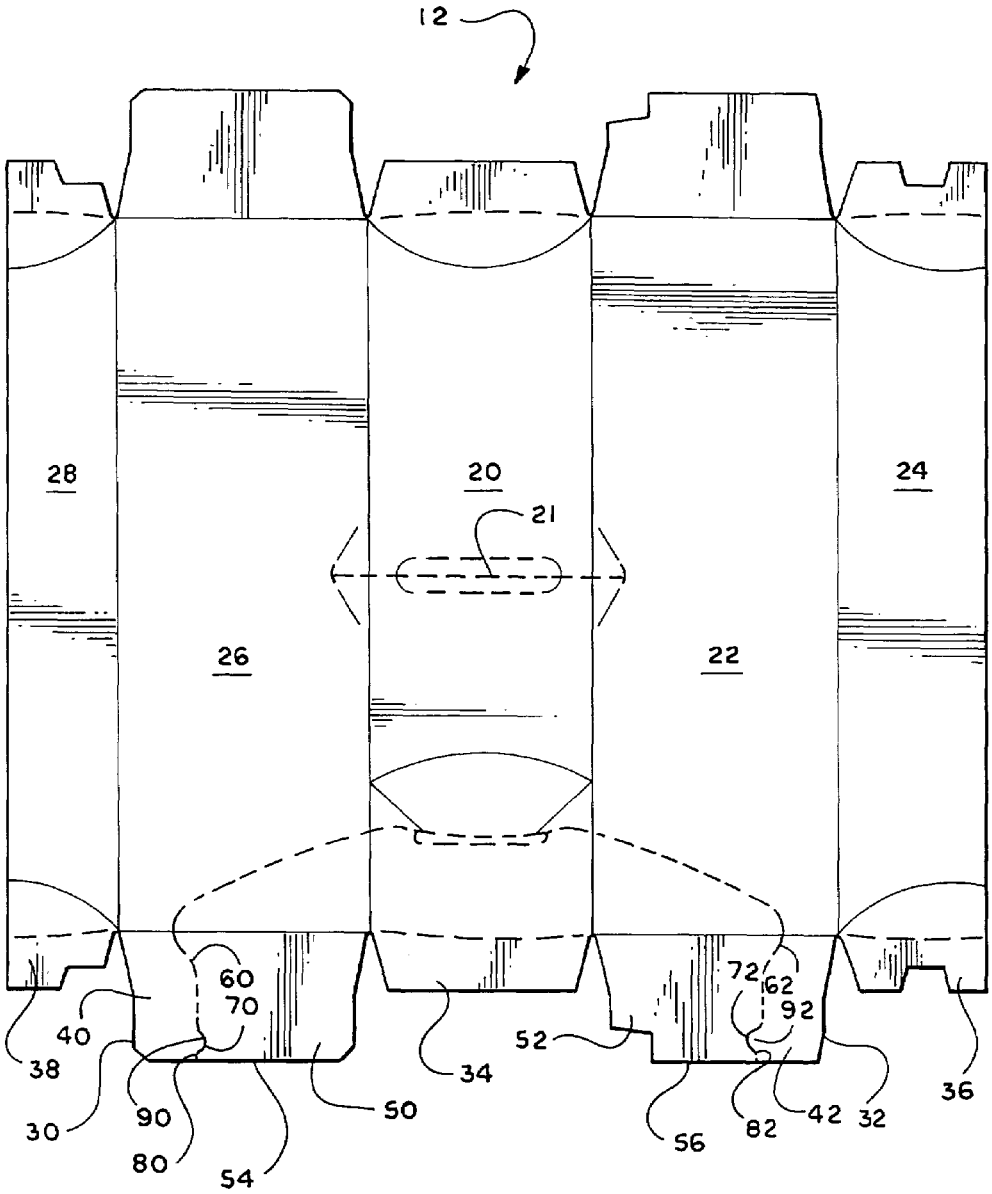
FIG. 5 is a plan of a blank for forming the carton of FIG. 1.

The carton 10 has an end region that terminates in a composite wall formed from panels that overlap along a seam 58. The seam 58 is the overlapping portion between panel edges 54 and 56. In the illustrations of the erected carton, one panel edge 54 or 56 will be shown as hidden through use of a dotted line. For convenience of understanding the carton 10 structure will first be discussed. For this purpose, reference is now made simultaneously to FIG. 1 and FIG. 5. FIG. 5 is an illustration of a blank 12 for forming the carton of FIG. 1. The blank 12 is shown from its inner surface. That is, the carton 10 is formed by folding the blank 12 outwardly from the plane in which the illustration lies.

Using the disposition of the carton in FIG. 1 as a point of reference, a top panel, side panels 22, 26, and bottom wall panels 24, 28 are interconnected and form the basic tubular structure of the erected carton 10. A handle 21 is formed in the top panel 20. End structures of the carton are formed from what are typically referred to in the carton field as major and minor flaps.

The terms "flap" and "panel" will be used interchangeably in this discussion. Minor flaps 34, 36, 38 provide innermost closure for the end of the carton 10. For convenience and ease of understanding, the major flaps are described as left and right upper and lower portions. These orientations have been used as an aid in describing the invention and not as limitations upon its teachings. The right major flap (as viewed from a point of orientation facing the page illustrating the erected carton) has lower 40 and upper 50 portions. Likewise, the left major flap has lower 42 and upper 52 portions. Closure of the ends of the carton is accomplished by securing the end regions of the major flaps 40/50, 42/52 to one another in overlapping condition. The overlap of the end regions creates a seam 58 (as briefly mentioned above) defined between the edges 54, 56 of the major flaps.

A frangible line 60, 62 extends across each major panel 40/50, 42/52 and, in the carton illustrated, into other portions of the carton. The full extension of the frangible line defines a trough 100 that is separable from the carton 10. The trough 100 will be discussed later in this description. The frangible line 60, 62 is used as a reference point for denoting the lower 40, 42 and upper 50, 52 portions of the major flaps.

The frangible line 60, 62 may be any weakened line that facilitates separation of the panel portions lying on either side of the line. The invention contemplates frangible lines to include but not be limited to perforated lines, tear strips, fold lines and cut lines intermittently joined by nick members. In the carton-making field a "nick member" is generally considered to be an interconnecting sliver (or similar extremely small portion) of material bridging disjoined portions of material.

The frangible line that extends across the end wall of the carton results from the coincidence of the frangible line 60, 62 that extends across each major end flap 40/50, 42/52. Each frangible line segment that extends across the major flaps terminates at an edge 54, 56 of each major flap 40/50, 42/52. Each segment of the frangible line that extends across the seam (that is, the overlapping or overlapable portion of the major flap) is extensively weakened. That is, is more weakened than the other portion of the frangible line to enable even greater ease of separation. The extensively-weakened segments 70, 72 lie adjacent the edges of the major flaps. Extensive weakening may be accomplished by a deeper score or a more severely interrupted perforated line. In one aspect of the preferred embodiment of the invention, extensive weakening is accomplished by creating a cut line.

In a further aspect of the preferred embodiment, each extensively-weakened line segment 70, 72 includes a nick member 80, 82 near the line segment's 70, 72 intersection with the flap edge 54, 56, particularly when a cut line is used. The nick member helps stabilize the edge region of the flap during erection of the blank 12 into a carton 10.

Figure 2:
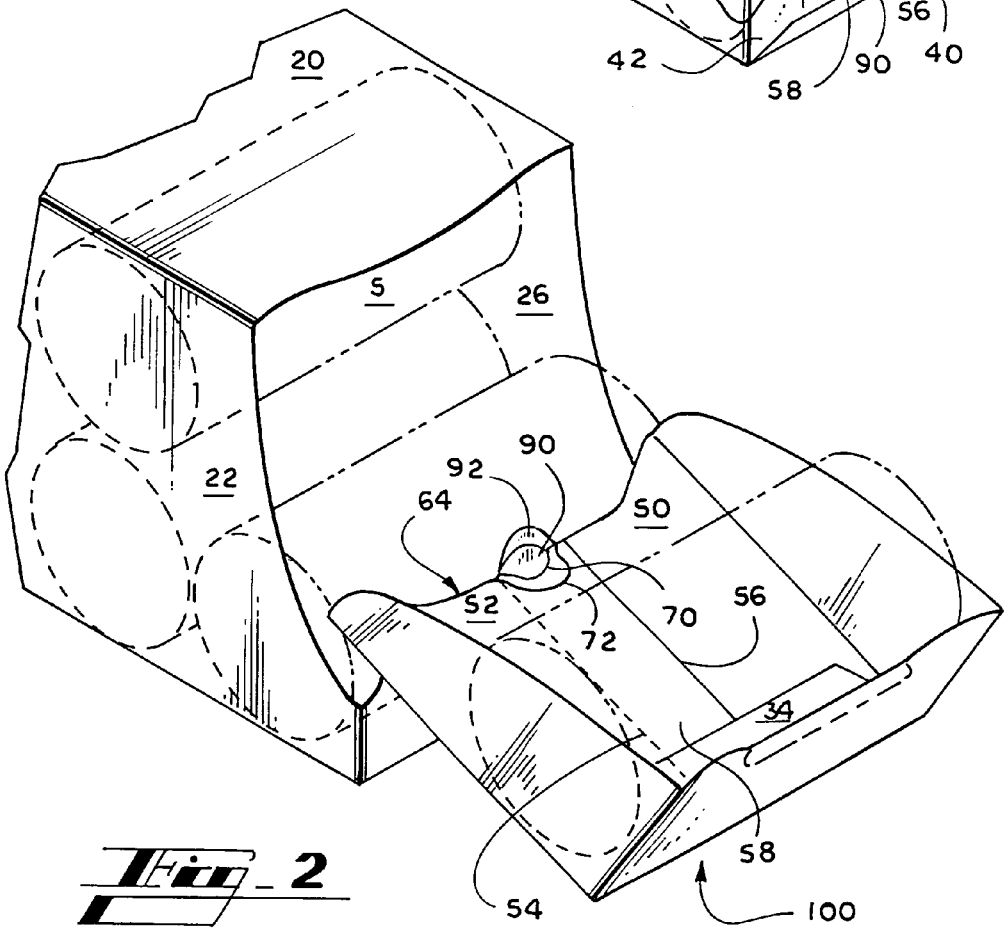
FIG. 2 is a perspective view of the carton of FIG. 1 wherein a trough that is hinged to the carton along a frangible line also serving as a severance line has been flipped down.

The frangible line 60, 62 creates a line along which portions of the carton wall that lie on either side of the line may be severed from one another. The frangible line also creates a hinge about which the opposing panel portions may be pivoted with respect to one another. Reference now may also be made to FIG. 2 wherein the frangible line serves as a hinge 64 between lower 40, 42 and upper 50, 52 major flap portions. The hinged portions may thereafter also be separated from one another by tearing along the hinge/frangible line. The extensively-weakened line segment 70, 72 of the frangible line helps lessen or eliminate the impact of the reinforced carton region resulting from the seam 58. Along the extensively-weakened segments 70, 72 there is no carton material that will inhibit tearing or bending. At most, only an adhesive such as glue that may be used in joining the flaps will be present.

In accordance with another aspect of a preferred embodiment of the invention, the extensively-weakened line segments 70, 72 are arcuate. The arcuate line segment configuration facilitates greater ease of clean separation of panel portions and lessens the tendency of the panels to delaminate at the seam 58. The curvature of the arcuate segments produces an offset between the line where tearing or shearing stresses are being primarily applied and the region of the seam 58 where stresses are applied. In the case where the lower and upper portions of the end wall are pivoted out of a single plane along the hinge formed by the frangible line, as illustrated in FIG. 2, the offset created by the curvature causes opposing panel portions to completely sever from one another on either side of the extensively-weakened, or cut, line. Thus, there is no connection of wall or panel portions across the seam 58 at this juncture. Once the seam has been eliminated, tearing along the frangible line is easily accomplished. The curvature of the arcuate line segments also results in the creation of protrusions 90, 92 on one side of the line segments and notches on the opposing side. The protrusions are reinforced because of the panel overlap. Thus, as can be seen in FIG. 2, an upright member is created in the erected carton that helps facilitate separation of the wall/panel portions along the seam 58.

Figure 6:
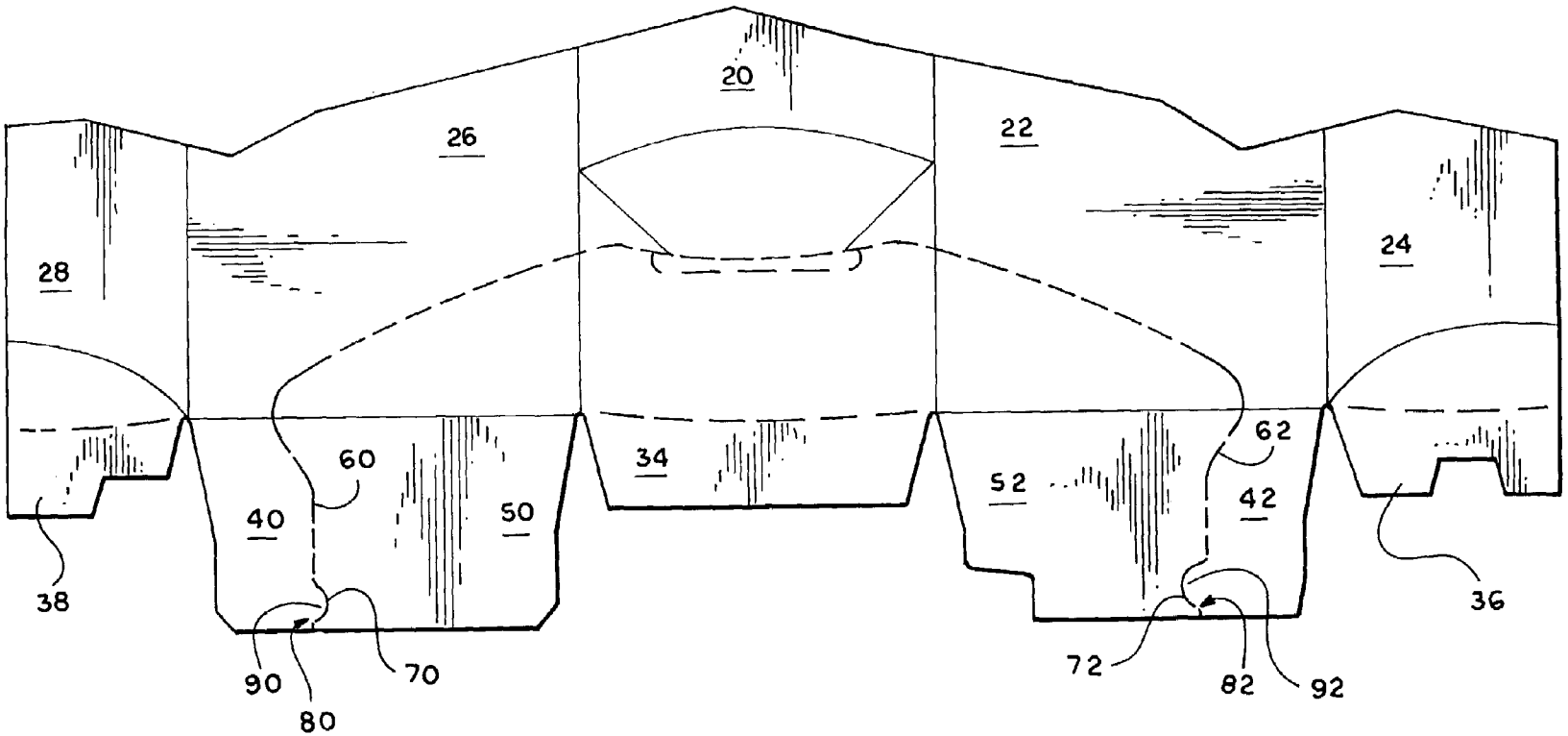
FIG. 6 is an enlarged plan view of a portion of the blank of FIG. 5.

The line segments are disposed for substantial alignment with respect to one another when the edge regions of the major flaps are overlapped and joined to one another. Although the invention teaches substantial alignment of the lien segments 70, 72, in accordance with another aspect of the preferred embodiment, this alignment also contemplates a slight offset between arcuate segments. This offset is accomplished when one arcuate segment 72 has a curvature greater than the other arcuate segment 70. The difference in degree of curvature of the line segments 70, 72 can be more clearly seen in the enlarged view of a portion of the blank 12 illustrated in FIG. 6 and in the trough illustrations of FIGS. 3 and 4 (which will be described in greater detail below). The resulting difference in size of protrusions 90, 92 can be seen in the exaggerated depiction of these features in FIG. 2. When the arcuate segments and protrusions are offset, the lower and upper wall portions may be more easily separated, particularly when pivoted, because clearance between the protrusion and notch is provided for. In the preferred embodiment, the arcuate segment 72 that lies within the inner ply of the seam 58 in flap 52 is made larger than the arcuate segment 70 that lies in the outer ply in flap 50 to provide the necessary clearance.

Figure 3:
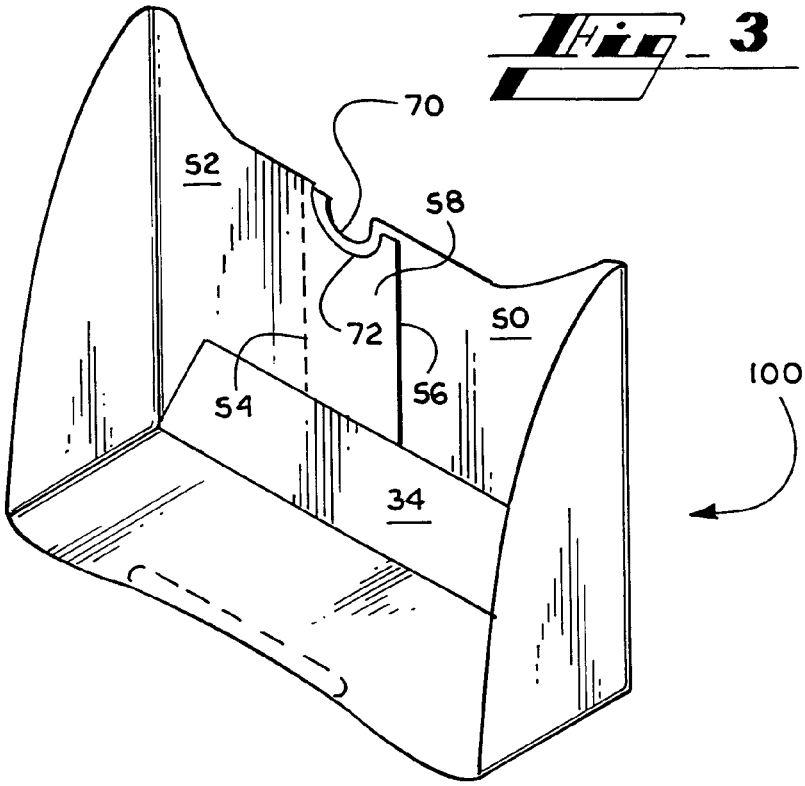
FIG. 3 is a perspective view of the trough of FIG. 2 in removed condition with respect to the remainder of the carton.
Figure 4:
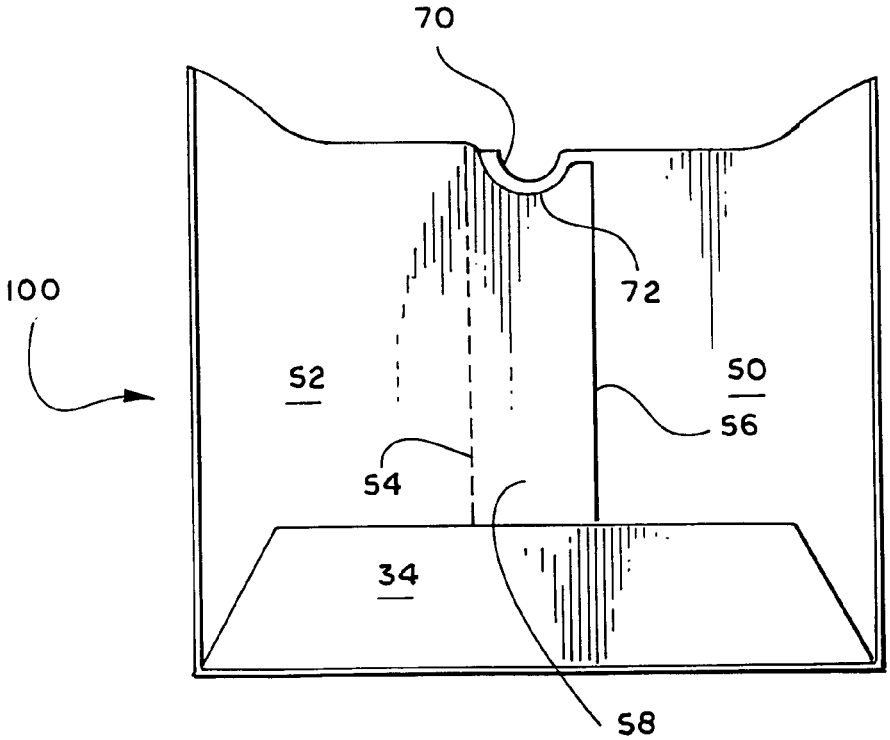
FIG. 4 is an elevational view of the trough of FIG. 3.

The invention is particularly useful in providing a hinge 64 that can subsequently serve as a line of severance for a trough 100 formed at the end of a carton 10. FIGS. 1 and 2 show the manner in which a frangible line inscribes a trough that can be pivoted downward to serve as a receptacle for articles such as cans 5. The pivoted trough can be removed by tearing along the hinge/severance line without resistance from the seam 58. The removed trough is shown in FIGS. 3 and 4. These views also illustrate the offset of the arcuate lien segments 70, 72 discussed above.

The invention provides a means for reliably severing a carton panel across a seam while maintaining the integrity of the carton formation process. The invention essentially offsets a region of reinforcement (created by the seam) from the line of severance (a frangible line). Because of the teachings of the invention, severance of a carton wall at a predetermined region is attainable in a carton that has been formed in a typical manner with seams disposed as appropriate for its function. The invention enables a severance mechanism to be utilised without being limited by the disposition of a carton seam. As illustrated above, the invention is particularly useful in the case where the line of severance serves as a hinge prior to severance. In this manner, the reinforced seam is even further isolated from the line of severance.

Use of terms such as top, bottom, side, end, longitudinal and transverse are used for convenience and to provide a point of reference in the description of the preferred embodiment of the invention and are not meant to limit the scope of the invention. Modifications may be made in the foregoing without departing from the scope and spirit of the claimed invention.

What is claimed is:

1. A severable carton wall comprising:

a substantially vertically disposed composite wall formed from a pair of overlapping panels joined along a seam, said seam comprising an overlap of respective end portions of said panels; and a frangible line extending across the composite wall, traversing the seam, defining a removable upper portion of said composite wall;

wherein the frangible line includes an extensively-weakened segment that substantially traverses the seam, wherein the extensively-weakened segment is shaped and disposed such that the extensively-weakened segment defines a notch in said removable upper portion within said seam of said removable upper portion, said extensively-weakened segment including a pair of cut lines formed respectively in said end portions of said panels such that the cut lines define a pair of secured protrusions formed respectively from said panels and extending upwardly from a lower portion of said composite wall, wherein the frangible line further includes a fold line segment extending away from said protrusions to facilitate separation of the composite wall along the extensively-weakened segment when said removable upper portion is pivoted about said fold line segment, and wherein said protrusions are joined directly to the lower portion of the composite wall without a hinged connection.

2. The carton of claim 1, wherein each of said cut lines terminates at a nick member disposed proximate an end edge of a respective one of the panels.

3. A severable carton wall comprising:

a substantially vertically disposed composite wall formed from a pair of overlapping panels joined along a seam, said seam comprising an overlap of respective end portions of said panels; and a frangible line extending across the composite wall, traversing the seam, defining a removable upper portion of said composite wall;

wherein a segment of the frangible line that substantially traverses the seam is an extensively-weakened segment.

wherein the extensively-weakened segment is shaped and disposed such that the extensively-weakened segment defines a notch in said removable upper portion within said seam of said removable upper portion, said extensively-weakened segment including a pair of cut lines formed respectively in said end portions of said panels such that the cut lines define a pair of secured protrusions formed respectively from said panels and extending upwardly from a lower portion of said composite wall to facilitate separation of the composite wall along the extensively-weakened segment, wherein said protrusions are joined directly to the lower portion of the composite wall without a hinged connection, and wherein each of the cut lines has a highest point along said each cut line, said highest point along one of the cut lines being disposed at a lower elevation than said highest point along the other of the cut lines.

4. The carton of claim 3, wherein said one of the cut lines is formed in the panel that is disposed outermost with respect to the seam, and said other of the cut lines is formed in the other panel that is disposed innermost with respect to the seam.

5. The carton of claim 3, wherein said cut lines extend alongside each other such that a clearance is provided between said cut lines.

6. A carton comprising:

top, bottom and a pair of side walls interconnected to form a substantially tubular structure having at least one end region terminating in a composite end wall, said composite end wall being formed from a pair of overlapping panels joined together along a seam, said seam comprising an overlap of respective end portions of said panels; and a separable trough formed from a portion of the one end region and hingably and severably connected to the composite end wall along a frangible line that traverses the seam;

wherein said frangible line comprises a pair of spaced, substantially straight segments extending respectively from said side walls toward each other and an extensively-weakened segment substantially traversing the seam and spanning a space between said straight segments, and wherein said extensively-weakened segment is configured such that the extensively-weakened segment defines a notch in said trough within said trough, whereby when said trough is partially severed from the carton and pivoted about said straight segments, severance of said trough from the carton along said extensively-weakened segment is facilitated.

7. The carton of claim 6, wherein said straight segments are interconnected only by said extensively-weakened segment.

8. The carton of claim 6, wherein said extensively-weakened segment includes a pair of cut lines formed respectively in said end portions of said panels such that the cut lines define a pair of secured protrusions formed respectively from said panels and extending upwardly from said composite end wall when said trough is partially severed from the carton and pivoted about said straight segments.

9. The carton of claim 8, wherein said protrusions are joined directly to the composite end wall without a hinged connection.

10. The carton of claim 8, wherein each of the cut lines has a highest point along said each cut line, said highest point along one of the cut lines being disposed at a lower elevation than said highest point along the other of the cut lines.

11. The carton of claim 10, wherein said one of the cut lines is formed in the panel that is disposed outermost with respect to the seam, and said other of the cut lines is formed in the other panel that is disposed innermost with respect to the seam.

12. The carton of claim 8, wherein each of said cut lines terminates at a nick member disposed proximate an end edge of a respective one of the panels.

13. The carton of claim 6, wherein the trough is formed in part from the top wall, in part from the composite end wall and in part from the side walls, the trough being severably connected to the top and side walls.

14. The carton of claim 6, wherein said frangible line is disposed across the composite end wall and extends into the side walls so that the trough is severably connected to the side walls.

15. The carton of claim 14, wherein said frangible line extends into the top wall such that the frangible line extends across the top wall.

* * * * *